US005139199A

United States Patent [19]

Jeffrey et al.

[11] Patent Number: 5,139,199

[45] Date of Patent: Aug. 18, 1992

[54] SPRAY HEADS

[75] Inventors: William A. Jeffrey, Edinburgh; Patrick J. M. Krause, Rosewell, both of Scotland

[73] Assignee: National Research Development Corporation, London, England

[21] Appl. No.: 605,099

[22] Filed: Oct. 30, 1990

[30] Foreign Application Priority Data

Oct. 31, 1989 [GB] United Kingdom ..... 8924475

[51] Int. Cl.[5] ..... B05B 3/10

[52] U.S. Cl. ..... 239/222.19; 239/127; 239/509; 239/520

[58] Field of Search ..... 239/222.11, 222.17, 239/222.19, 222.21, 124, 127, 520, 509

[56] References Cited

U.S. PATENT DOCUMENTS

| | | | |
|---|---|---|---|
| 1,078,543 | 10/1911 | Hadden | 239/222.17 |
| 1,322,466 | 11/1919 | Partridge | 239/222.17 |
| 3,081,949 | 3/1963 | Simmons | 239/520 X |
| 3,532,273 | 10/1970 | Siddall et al. | 239/222.17 |
| 4,685,592 | 8/1987 | Vanderjagt | 239/127 X |
| 4,760,958 | 8/1988 | Greenberg | 239/222.21 |

FOREIGN PATENT DOCUMENTS

| | | | |
|---|---|---|---|
| 170163 | 7/1951 | Austria | 239/222.21 |
| 1051305 | 12/1966 | United Kingdom . | |
| 1151448 | 5/1969 | United Kingdom . | |
| 1343337 | 1/1974 | United Kingdom . | |
| 1442662 | 7/1976 | United Kingdom . | |
| 1486427 | 9/1977 | United Kingdom . | |
| 2024047 | 1/1980 | United Kingdom . | |
| 2116456 | 9/1983 | United Kingdom . | |
| 2188255 | 9/1987 | United Kingdom | 239/222.17 |

*Primary Examiner*—Andres Kashnikow
*Assistant Examiner*—Kevin P. Weldon
*Attorney, Agent, or Firm*—Cushman, Darby & Cushman

[57] ABSTRACT

A spray head including a flow passage for the liquid to be sprayed and a rotary distributor head interrupting the forward flow of liquid from the flow passage. The distributor head presents the liquid flow with an imperforate redistribution surface which inclines obliquely across the flow so as in operation to redirect the flow both forwardly and rearwardly of the distributor head. In one version of the device, the distributor is provided with angled impeller surfaces so as to derive a distributor-rotating reaction force from the flow of liquid received from the flow passage.

9 Claims, 3 Drawing Sheets

SPRAY HEADS

BACKGROUND OF THE INVENTION

1. Field of the Invention

The present invention relates to spray heads, to tank-flushing assemblies incorporating one or more such spray heads and to spray application equipment provided therewith e.g. for use in agriculture, horticulture and forestry.

2. Description of the Related Art

In order to decontaminate agricultural spray application equipment after use, normally the spray tank must be filled to the neck with water to rinse chemical solution from all internal surfaces. The washing procedure may have to be repeated several times when changing to a different pesticide. As tractor mounted sprayers commonly have capacities of 1500 liters or more, the volume of contaminated washings generated can be substantial. Where the washings must be sprayed out, this is wasteful of both the land area required and the operators' time.

UK Patent Application No. 8828270 discloses a tank-flushing assembly in which only a fraction of the rinse water hitherto required is sprayed over the inner walls of the tank in a recirculating flow. Reducing the amount of liquid in this way effects a corresponding reduction in the required capacity or area of any disposal facility, and reduces the time needed to clean out the tank(s).

Although such a system is perfectly adequate for smooth walled tanks which are substantially free from internal obstructions, most spray tanks contain one or more internal hoses, as well as other obstructions like the filter basket etc. Some designs, for example, have features moulded into the tanks which cause channelling or separation of the down-wash from the tank walls. In one such design, for example, a channel is moulded around the waistline of the tank to locate a horizontal mounting strap and the resulting protrusion inside the tank interrupts the down-wash from the simple overhead spray heads so that there is a risk of pockets of chemical residue being left behind underneath the protrusion.

SUMMARY OF THE INVENTION

An object of the present invention is to provide an improved spray head e.g. for use in tank-flushing assemblies of the kind disclosed in UKPA 8828270.

According to the present invention, a spray head includes a flow passage for the liquid to be sprayed and a distributor positioned to interrupt the flow of liquid from the flow passage and operative to disperse a significant proportion of said flow to the flow passage side of the distributor.

Conveniently, the distributor presents an inclined e.g. an obliquely inclined, surface to the flow of liquid from the flow passage.

Conveniently, the distributor is mounted for rotation about an axis parallel to the flow of liquid from the flow passage.

Conveniently, when the distributor is mounted for rotation in this way, then it is also provided with helically disposed or functionally similar impeller surfaces so as to derive a distributor-rotating reaction force from the flow of liquid received from the flow passage.

Conveniently, the distributor is secured to, or formed with, a hub portion mounted in a hollow support with the hub/support clearance space providing the flow passage.

Conveniently, the clearance between the hub and its support is such that the space:hub cross-sectional area ratio lies in the range 0.29 to 0.50.

Specific embodiments of the present invention are intended for use in flushing the spray tanks of agricultural spray application equipment and liquid storage equipment e.g. bulk milk tanks. These spray heads may either be fitted as part of the original equipment or they may be supplied in kit form for retro-fitting to existing equipment.

The invention also includes tank flushing assemblies incorporating one or more spray heads in accordance with the present invention and spray application equipment or liquid storage equipment provided with such assemblies.

An embodiment of the present invention will now be described, by way of example only, with reference to the accompanying drawings in which:

DETAILED DESCRIPTION OF THE PRESENTLY PREFERRED EXEMPLARY EMBODIMENTS

Figure 1:
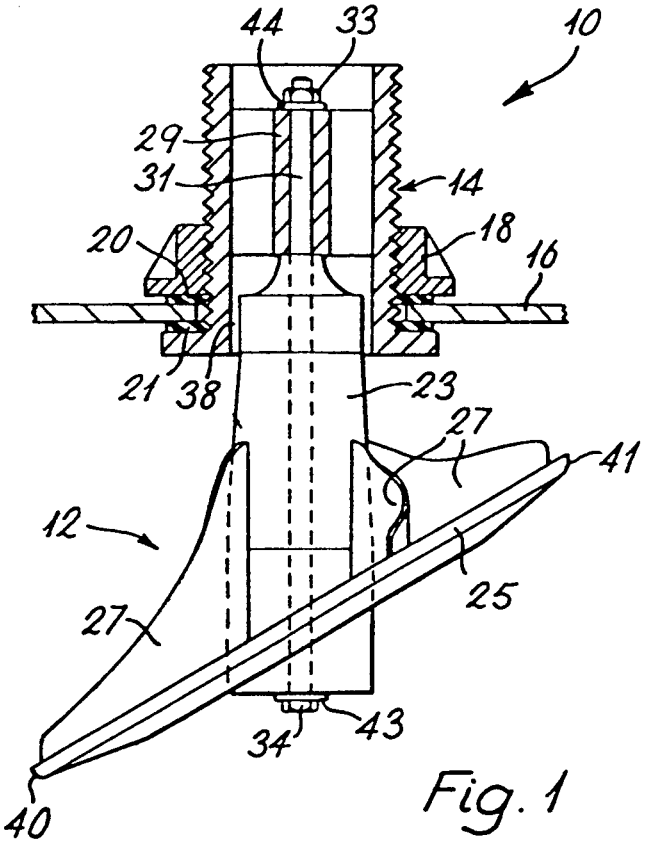
FIG. 1 is a part sectional side view of one form of spray head in accordance with the present invention.
Figure 3:
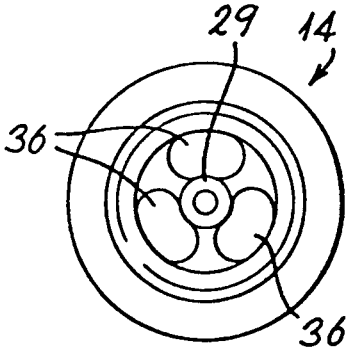
FIGS. 2 and 3 are plan views of the spray head distributor and distributor support used in the spray head.
Figure 2:
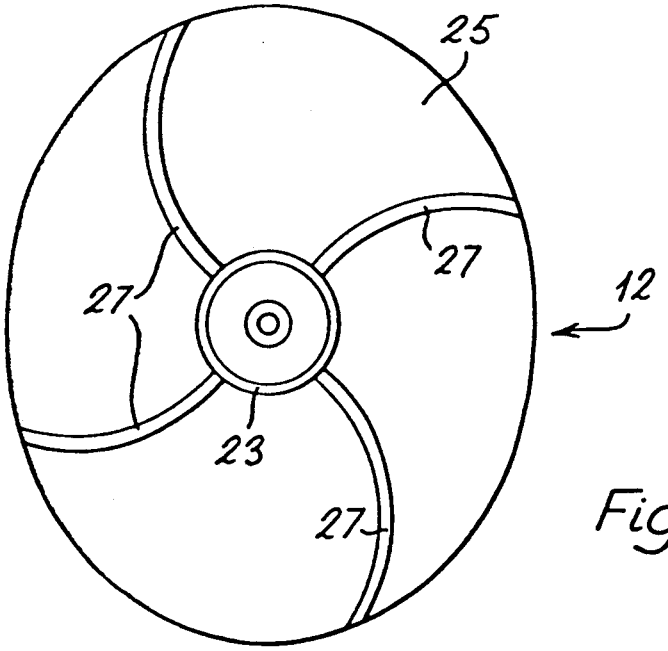

Thus referring first to FIGS. 1 to 3 of the drawing, it will be seen that the illustrated spray head unit 10 comprises a distributor 12 which is rotationally mounted in an upper support 14. This latter acts as a bulkhead fitting to fix unit 10 in a suitable hole drilled into the tank top 16. The support is secured in plane by a location nut 18, rubber seals 20,21 being included to provide a water-tight fitting.

As best seen from FIG. 1, the distributor 12 includes a hub portion 23, an obliquely inclined circular distributor plate 25 and impeller blades provided by four curved vanes 27 extending between the hub portion 23 and the distributor plate 25.

A central boss 29 (FIG. 3) of the support 14 locates a steel pin 31 which acts as an axle for the rotating distributor 12. The axle pin 31 is preferably small in diameter e.g. 4 mm, to minimise friction. Reference numerals 33,34 indicate lock nuts at either end of pin 31.

At its upper end, the support 14 is threaded to permit connection to a flush system pipework for the tank. As can be seen from FIGS. 1 and 3, liquid from this system can pass down through the three holes 36 provided around the boss 29 (FIG. 3) to flow through the passage provided by the annular hub/support clearance space 38 (FIG. 1). This has the effect of accelerating the liquid flow as it passes through the upper support on its way to the distributor plate 25, and of spreading the flow evenly around the distributor hub 23.

In practice, the value chosen for the annular clearance space between the hub and its support should be such that the space:hub cross-sectional area ratio lies in the range 0.29 to 0.50. With smaller clearances, the resulting end thrust on the distributor 12 will inhibit its rotation while with larger clearances the flow velocity will be reduced below what is required to give an acceptable throw of spray from the rotating distributor 12.

On striking the distributor plate 25, the direction of the flow is turned to spread radially across the plate. The impeller vanes 27 prevent flow from concentrating on the downhill edge 40 of the plate.

In operation, a proportion of the flow travels some distance across the plate 25 before striking a vane 27. Much of this flow then deflects to follow the vane to the periphery of the plate, but some of the rinse liquid (especially that at the uphill edge 41 of the distributor plate) is deflected upwards towards the adjacent region of tank top 16. This ensures that the local area of the tank wall around the spray head 10 is not missed.

In addition to redirecting the liquid flow as above described, the four curved vanes 27 also act like turbine blades to induce rotation of the distributor about its vertical rotation axis. To facilitate this rotation by reducing the friction forces present when the distributor is under thrust load, a nylon washer 43 is included between the bottom end of the distributor hub 23 and the lower retaining nut 34 on the pin 31. A similar washer 44 is provided at the top end of the boss 29.

In a modification (not shown), the nut 34 and washer 44 are replaced by a thick PTFE thrust washer attached to the axle 31 by a split pin passing through both components. As an alternative to the split pin, some sort of spring clip may be used instead to secure the PTFE washer in place.

The distributor plate 25 can be inclined at any suitable angle to the rotation axis of the distributor, the value chosen in any particular case being necessarily a compromise between flow pattern depth and side thrust on the axle pin 31, both of which increase as the plate angle to the distributor's rotation axis decreases. The angle of 60° chosen for the illustrated embodiment is a typical value where two such spray heads are to be used in the manner of FIG. 4 for the usual sort of spray tanks currently in use on commercially available agricultural spray application equipment.

Figure 4:
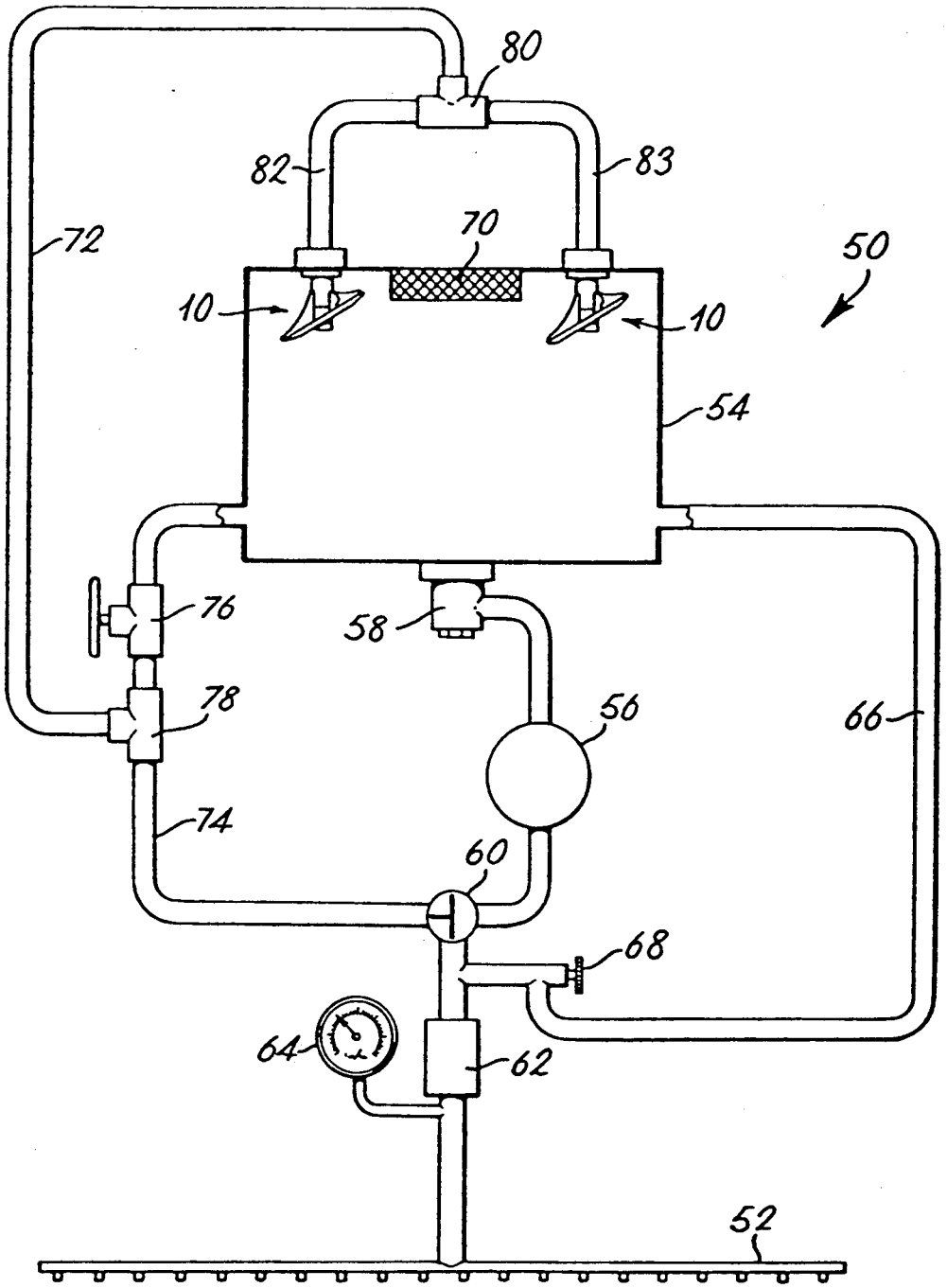
FIG. 4 is a schematic representation of spray application equipment using a tank-flushing assembly in accordance with the present invention.
Figure 5A:
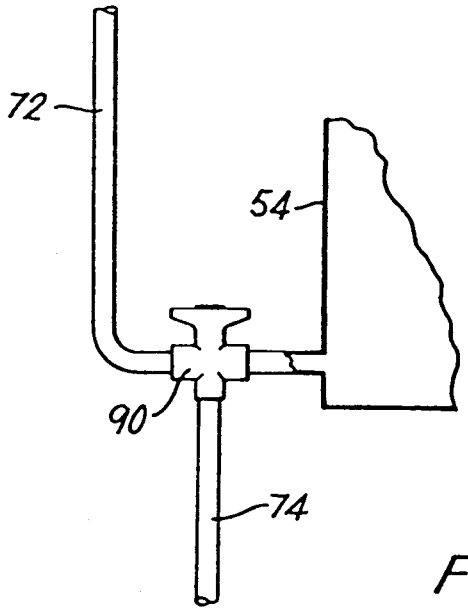
FIGS. 5(*a*) to 5(*d*) show a scrap view of a modification of the FIG. 4 equipment and three vertical sections of the valve used in that modification.
Figure 5B:
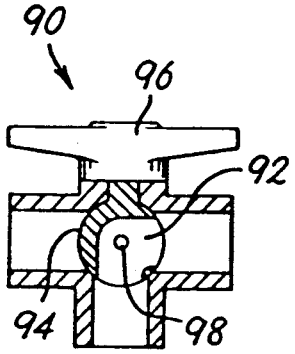
Figure 5C:
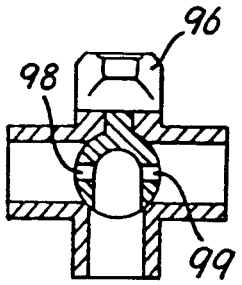
Figure 5D:
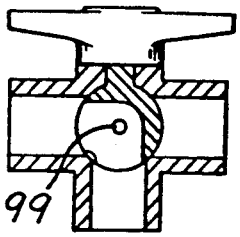

Turning now to FIG. 4 of the drawings, spray application equipment 50 comprises a spray boom 52, a tank 54 for the liquid (herbicide etc.) to be applied by the boom, and a pump 56 for moving liquid from the tank to the spray boom through a suction filter 58, main control valve 60 and delivery filter 62. Reference numeral 64 indicates the usual pressure guage while reference numeral 66 indicates a conventional by-pass agitator feed with its pressure relief valve 68. The tank 54 is top-loaded through the usual inlet port filter 70.

As has already been explained above, once spraying has been completed, the tank 54 may be partially filled with water for rinsing purposes and in accordance with another aspect of the present invention, a rinse recirculation line 72 is tapped off from the usual "spray-off" return line 74 and a suitable two way valve is provided at 76. With valve 76 open, the return line 72 will operate in the usual way, but when valve 76 is closed, liquid which would have returned through the valve direct to the tank 54, is instead redirected via tapping 78 into the rinse recirculation line 72.

At its upper end, the recirculation line is connected via a T-junction 80 and two equal-length hoses 82,83 to two spray heads 10 each as hereinbefore described and illustrated with reference to the earlier Figures.

Thus, once spraying has been completed and the tank 54 has been emptied of its original contents, the tank is filled about one tenth full with water. Then, with valve 76 closed and the main control valve 60 turned to its alternative position (rather than to that illustrated in FIG. 4), the pump 56 is used to circulate rinsing water from the tank 54 along line 72 and back through the spray heads 10 as above described. This process is continued until the walls of the tank have been thoroughly rinsed by the spray from spray heads 10 whereupon the one way valve 76 is again opened and control valve 60 is returned to its illustrated position to spray out the contaminated washings through the nozzles on spray boom 52.

The illustrated spray head is intended to be applicable to any spray tank, and may be either fitted as original equipment, or supplied in kit form for retro-fitting to existing equipment without major modification (for example without fitting an extra tank).

In a modification, shown in the scrap view of FIG. 5(*a*), the valve 76 is omitted and the tapping 78 is replaced by a three-way valve 90 providing an L-shaped flow channel 92 in its spherical valve member 94.

In between spray applications, the control knob 96 is set as shown in FIG. 5(*b*) and the valve connects the "spray-off" return line 74 directly to the tank 54 to promote agitation of the spray liquid remaining in the tank. In this position, the rinse re-circulation line 72 is shut off by the valve to prevent dribble from the spray heads 10.

When spraying has been completed and it is desired to rinse the tank, the valve member is rotated to the position shown in FIG. 5(*d*) so that the rinse water now in tank 54 can be directed via return line 74 and re-circulation line 72 to the spray heads 10.

Pilot holes 98,99 formed in the side walls of the flow channel 92 prevent the flow from line 74 from being interrupted as the valve passes through the midway position shown in FIG. 5(*c*). This avoids the pressure pulse that would otherwise result as the valve member 94 is rotated from one position to the other and the consequent blow-off of the push-fit hoses used for lines 74 etc.

The principal advantage of the present invention e.g. over the system of UKPA 8828270, is that a more efficient flushing of the more complexly shaped spray tanks can be obtained than hitherto. This is firstly because rotating the direction of the rinsing spray reduces the chance of missed areas, either behind obstructions or where the flow is channelled, and secondly, because part of the spray can be directed to the lower regions in the tank which may be masked from a simple symmetrical overhead spray. The present invention also shares with the system of UKPA 8828270 the advantage over the prior art systems that significantly less time is required than with the conventional fill-and-discharge rinsing technique previously employed.

Although in the illustrated tank-flushing assembly only two spray heads according to the present invention have been used, it will be appreciated that in other situations, the assembly may include only a single such spray head or it may include three or more such spray heads, if desired. In all such cases, the pump or pumps used should preferably be able to supply the or each such spray head with at least 40 liters per minute of the flushing liquid.

We claim:

1. A spray head comprising:

a flow passage for a liquid to be sprayed and a rotary distributor head interrupting a forward flow of the liquid from the flow passage, said rotary distributor head including an imperforate redistribution surface inclined obliquely across said direction of forward flow to redirect said flow both forwardly and rearwardly of said distributor head;

a liquid-supply vessel, pipework joining the liquid-supply vessel with the spray head, and pump means for circulating liquid from the liquid supply vessel through the pipework and the spray head.

2. A spray head as claimed in claim 1 wherein the distributor is mounted for rotation about an axis which is substantially parallel to the direction of liquid flow from the flow passage.

3. A spray head as claimed in claim 2 wherein the distributor is provided with angled impeller surfaces to derive a distributor rotating reaction force from the flow of liquid received from the flow passage.

4. A spray head as claimed in claim 1 wherein the distributor is secured to a hub portion mounted in a hollow support, adjacent surfaces of the hub and the support define a clearance space which provides the flow passage.

5. A spray head as claimed in claim 4 wherein the clearance between the hub and its support is such that the space:hub cross-sectional area ratio lies in the range of 0.29 to 0.50.

6. A spray head as claimed in claim 1 further including spray application means for applying liquid to an external location.

7. A spray head as claimed in claim 1 further including transfer means for transferring liquid to an external location.

8. A spray head as claimed in claim 1 wherein the imperforate redistribution surface has a raised side being sloped up towards the flow passage to deflect fluid with a generally upward direction and a lowered side being sloped down away from the flow passage to deflect fluid with a generally downward direction.

9. A spray head as claimed in claim 8 wherein the points between the raised side and lowered side of said imperforate redistribution surface evenly distribute the fluid so that a complete spray distribution is achieved.

* * * * *